US008348778B2

(12) United States Patent
Park

(10) Patent No.: US 8,348,778 B2
(45) Date of Patent: Jan. 8, 2013

(54) GOLF BALL FEEDING APPARATUS

(76) Inventor: Sang-Won Park, Seoul (KR)

( * ) Notice: Subject to any disclaimer, the term of this patent is extended or adjusted under 35 U.S.C. 154(b) by 129 days.

(21) Appl. No.: 13/126,168

(22) PCT Filed: Oct. 9, 2009

(86) PCT No.: PCT/KR2009/005773
§ 371 (c)(1),
(2), (4) Date: Apr. 26, 2011

(87) PCT Pub. No.: WO2010/050682
PCT Pub. Date: May 6, 2010

(65) Prior Publication Data

US 2011/0207543 A1 Aug. 25, 2011

(30) Foreign Application Priority Data

Oct. 29, 2008 (KR) ..... 20-2008-0014454 U

(51) Int. Cl.
*A63B 69/36* (2006.01)

(52) U.S. Cl. ..... 473/136; 473/137

(58) Field of Classification Search ..... 473/132–137
See application file for complete search history.

(56) References Cited

U.S. PATENT DOCUMENTS

| | | | | | |
|---|---|---|---|---|---|
| 3,423,097 | A * | 1/1969 | Fry | 473/136 |
| 4,319,753 | A * | 3/1982 | Mann | 473/133 |
| 4,815,744 | A * | 3/1989 | Diamandis | 473/136 |
| 5,078,401 | A * | 1/1992 | Fehrenbach et al. | 473/133 |
| 5,330,194 | A * | 7/1994 | Copeland | 473/132 |
| 5,348,305 | A * | 9/1994 | Lowe | 473/133 |
| 5,356,148 | A * | 10/1994 | Elder, Jr. | 473/133 |
| 5,603,664 | A * | 2/1997 | Provost | 473/134 |
| 5,611,737 | A * | 3/1997 | Rau et al. | 473/137 |
| 6,984,178 | B1 * | 1/2006 | Chen | 473/136 |
| 2011/0092302 | A1 * | 4/2011 | Cho | 473/137 |

FOREIGN PATENT DOCUMENTS

| | | | |
|---|---|---|---|
| KR | 10-1999-0069787 | A | 9/1999 |
| KR | 20-0388366 | Y1 | 6/2005 |
| KR | 20-2009-0008533 | U | 8/2009 |

* cited by examiner

*Primary Examiner* — Steven Wong

(57) ABSTRACT

The present invention relates to a feed unit 10 mounted at one side of an interior of a body 1 so as to feed a golf ball 40 and an adjustment unit 20 mounted at an other side of the interior of the body 1 so as to adjust a height of a golf tee 30, wherein the feed unit 10 includes: a main body 11, a pulley 14, movable plates 15, and a feed motor 18. The adjustment unit 20includes: an upper plate 21, a lower plate 22, a support rod 23, guide rods 24, an elevating board 25, golf tee 30, gears 26*a*, 26*b*, a stepping motor 27, a power gear 28, and a timing belt 29whereby the golf ball 40 dispensed through the outlet port 13 of the feed unit 10 is teed up on the golf tee 30 of the adjustment unit 20.

1 Claim, 6 Drawing Sheets

GOLF BALL FEEDING APPARATUS

TECHNICAL FIELD

The present invention relates to a golf ball feeding apparatus which automatically feeds golf balls to a golfer in a golf practice court when the golfer practices golf shots in indoor golf training facilities and the like, and which allows adjustment of the height of a golf tee as desired based on the height or posture of the golfer so as to eliminate inconveniences caused by replacing the golf tee with an appropriate one for an individual golfer, thereby eliminating the troubles incurred in manually placing the golf balls on the golf tee by the golfer and reducing the labor costs needed for collecting and feeding golf balls.

BACKGROUND ART

Generally, golf balls are collected by a worker and supplied to a golfer after they are hit by the golfer in golf training facilities or the like, or alternatively, they are put into a storage box of a golf ball feeding apparatus, which is semi-automatically operated, to be supplied to the golfer. Furthermore, automatic ball basket feeding apparatuses are known which are operable automatically after the insertion of coins. When using coin-type automatic ball basket feeding apparatuses, the golf balls are fed manually to the golf ball feeding apparatus, but such system needs human labor and accompanies the issues of the stability and need for cleaning. Additionally, to operate the golf ball feeding apparatus, the golf balls are collected and put into the apparatus manually, and the coin-type ball basket feeding apparatus is cumbersome for working.

So as to solve the above-mentioned problems, on the other hand, there has been proposed another type of golf ball feeding apparatus, wherein after golf balls are hit by a golfer, they are collected by a horizontal or vertical conveyer and supplied to the golf ball feeding apparatus placed in the individual golf practice court. However, the conventional golf ball feeding apparatus does not have any device for controlling falling pressure of the golf balls during the processes of conveying the collected golf balls by the horizontal conveyer from a golf ball collecting device placed over the stand and supplying the golf balls to the golf ball feeding apparatus placed on the stand, so that a lot of noise is made, the golf balls are damaged or broken, portions to which the golf balls are dropped are damaged, and the process of conveying the golf balls from the horizontal conveyer installed beneath the stand to the golf ball feeding apparatus is not carried out gently, which cause frequent mechanical malfunctions.

In addition, to perform effective swing when the golfer practices golf shots in a golf training facility or the like, the height of a golf tee which supports a golf ball should be adjusted depending on the posture or height of the golfer. The golfer, however, has to individually choose the appropriate height of the golf tee and replace the previous one with the selected golf tee, which is cumbersome. In case where the golf ball is teed up on the top of the golf tee through the automatic golf ball feeding apparatus, especially, the difference of the heights between the golf tee and the golf ball feeding apparatus becomes large at the time of adjusting the height of the golf tee, so that when the golf ball is fed, the golf ball is not seated well on the golf tee well, thereby actually making it impossible to adjust the height of the golf tee.

DETAILED DESCRIPTION

Technical Problems

Accordingly, the present invention has been made to deal with the above-mentioned problems occurring in the prior art, and it is an object of the present invention to provide a golf ball feeding apparatus which automatically feeds golf balls to a golfer in a golf practice court when the golfer practices golf shots in indoor golf training facilities and the like, and which allows adjustment of the height of a golf tee as desired based on the height or posture of the golfer so as to eliminate inconveniences caused by replacing the golf tee with an appropriate one for an individual golfer, thereby eliminating the troubles incurred in manually placing the golf balls on the golf tee by the golfer and reducing the labor costs needed for collecting and feeding golf balls.

Technical Solutions

To accomplish the above object, according to the present invention, there is provided a golf ball feeding apparatus having a feed unit mounted at one side of an interior of a body so as to feed a golf ball and an adjustment unit mounted at an other side of the interior of the body so as to adjust a height of a golf tee, wherein the feed unit includes: a main body having a passage through which the golf ball passes, an inlet port and an outlet port formed at both ends of the passage, and shaft holes formed at both side walls thereof; a pulley fittingly disposed between the shaft holes of the main body; movable plates each having a bearing mounted thereon and disposed on both outer sides of the shaft holes of the main body in such a manner as to be coupled at one side thereof to the main body by means of shaft pins and be connected at the other side thereof with a spring mounted on the main body, thereby allowing the movable plates and the pulley to rotate about the shaft pins; and a feed motor mounted at one side movable plate and having a shaft coupled to the bearing and the pulley so as to rotate the pulley by the activation thereof, and wherein the adjustment unit includes: an upper plate having an entry/exit hole formed at one side thereof; a lower plate; a support rod disposed between the upper plate and the lower plate so as to fixedly support the upper plate and the lower plate; guide rods mounted at left and right sides on the underside of the entry/exit hole in such a manner as to be fixed between the upper plate and the lower plate; an elevating board adapted to insertedly fit around the guide rods in such a manner as to move upwardly and downwardly along the guide rods; the golf tee mounted on the elevating board; gears mounted at the back side of the elevating board in such a manner as to be located on the inner sides of the upper plate and the lower plate; a stepping motor mounted on one side of the lower plate; a power gear located at the shaft of the stepping motor; and a timing belt adapted to couple the power gear and the gears thereto in such a manner as to be fixed to one side of the elevating board, whereby the golf ball dispensed through the outlet port of the feed unit is teed up on the golf tee of the adjustment unit.

ADVANTAGEOUS EFFECTS

According to the present invention, as mentioned above, there is provided the golf ball feeding apparatus that automatically performs all of processes of collecting golf balls after a golfer hits the golf balls in a golf training facility and feeding the golf balls to stands for golfers, thereby improving the structure of the golf training facility to reduce the expenses required for maintaining the facility and decreasing inconvenient manual operations to reduce the labor costs, and that adjusts the height of the golf tee on which the golf ball is just located based on the height and posture of the golfer through simple manipulation, thereby freely handling various heights and postures of golfers to increase the swing practicing effects of the golfers and providing the simplicity in structure and the reduction of the production costs.

BEST MODES FOR PRACTICING INVENTION

Hereinafter, a golf ball feeding apparatus according to the present invention will be explained in detail with reference to the attached drawings.

Figure 1:
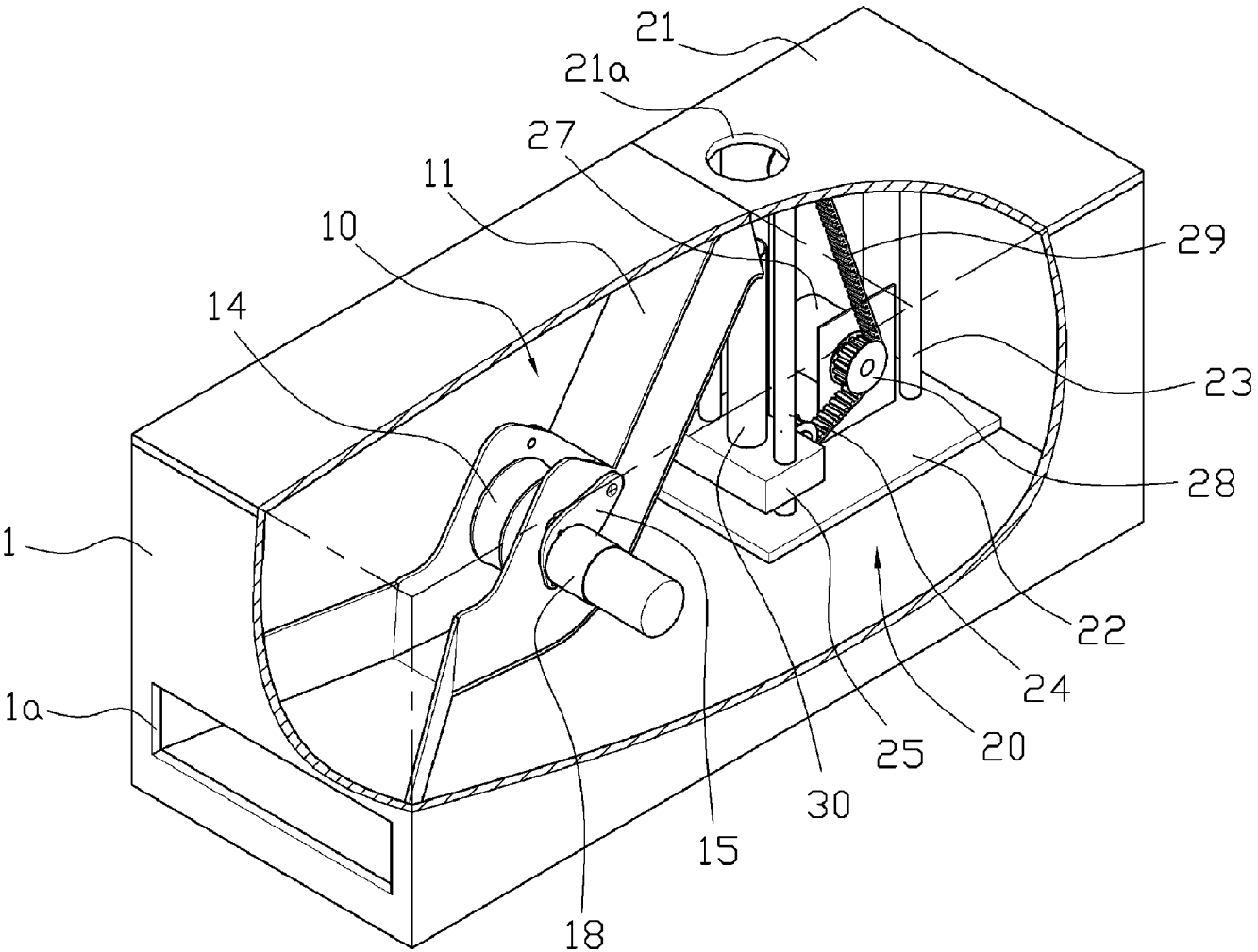
FIG. 1 is an incised perspective view showing a golf ball feeding apparatus according to the present invention.
Figure 2:
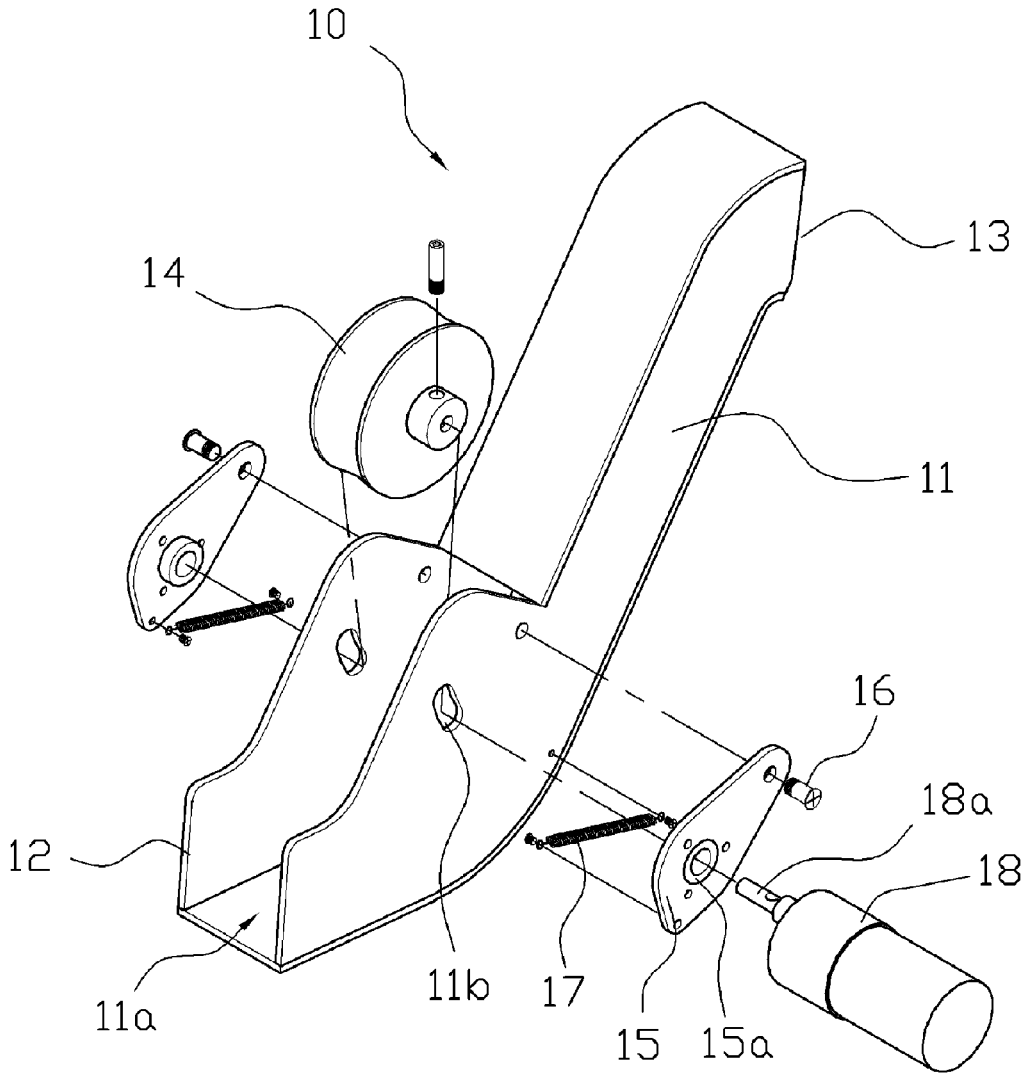
FIG. 2 is a separate perspective view showing a feed unit of the golf ball feeding apparatus according to the present invention.
Figure 3:
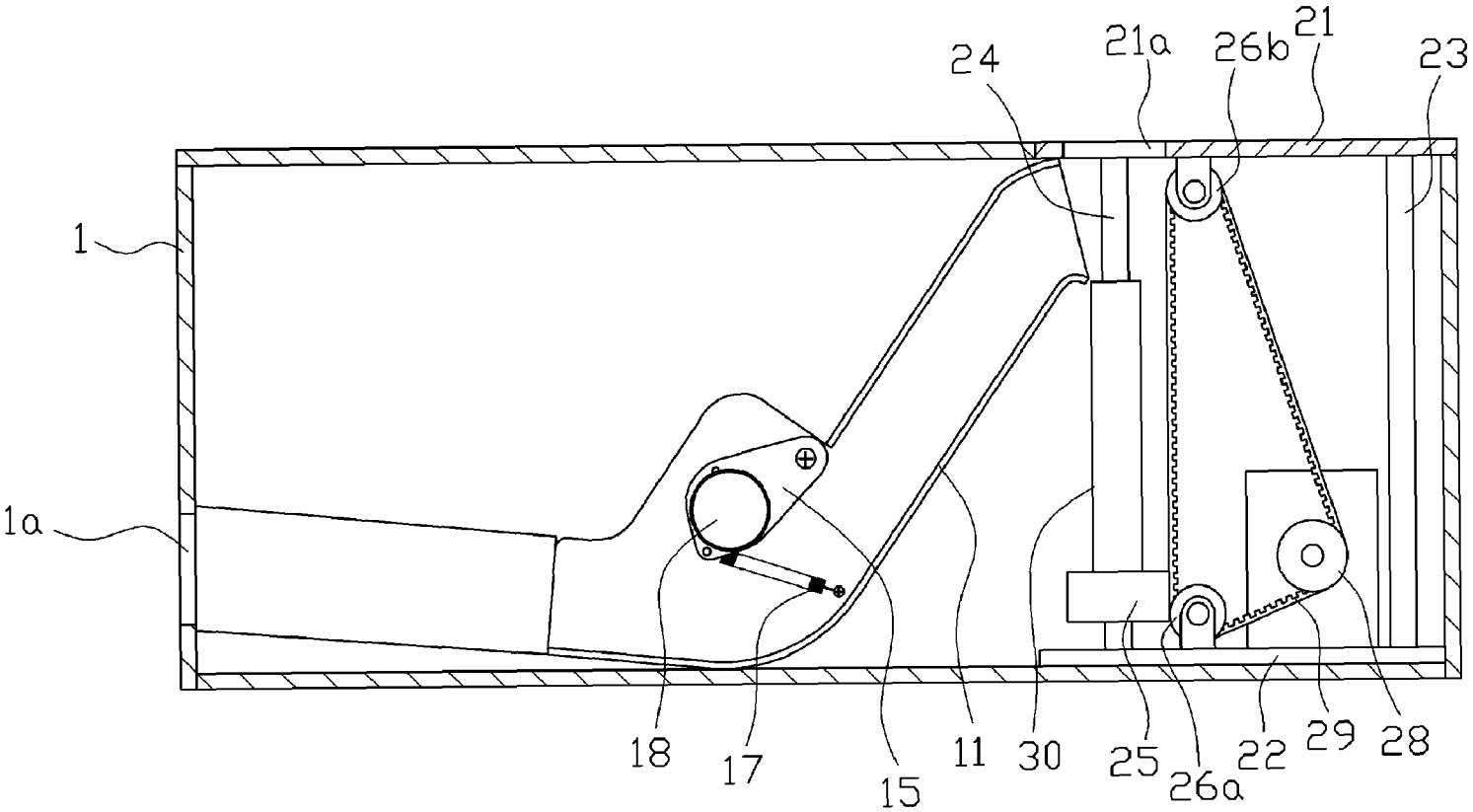
FIG. 3 is a sectional view showing the golf ball feeding apparatus according to the present invention.
Figure 4:
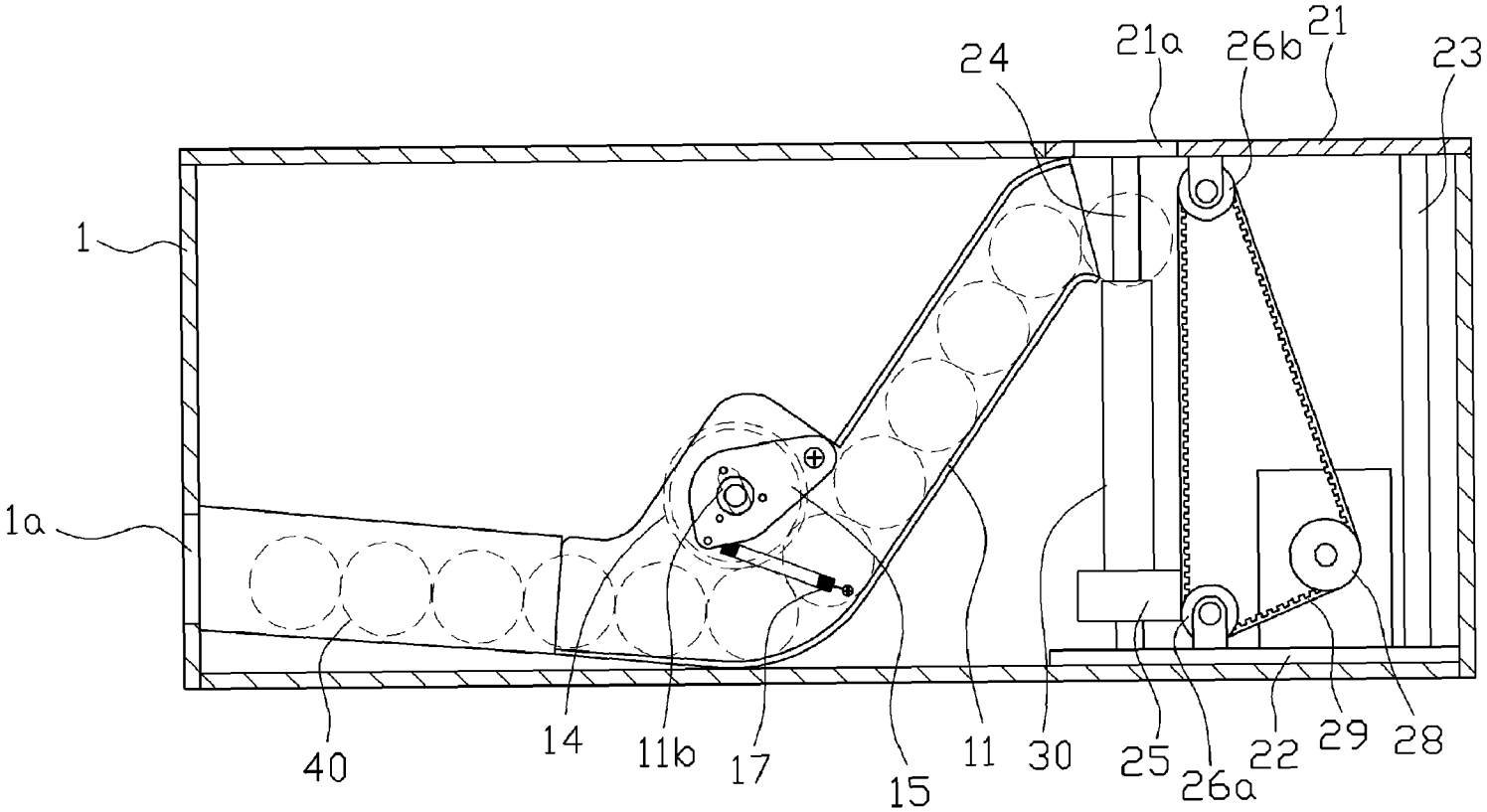
FIGS. 4 to 6 are sectional views showing the operations of the golf ball feeding apparatus according to the present invention.
Figure 5:
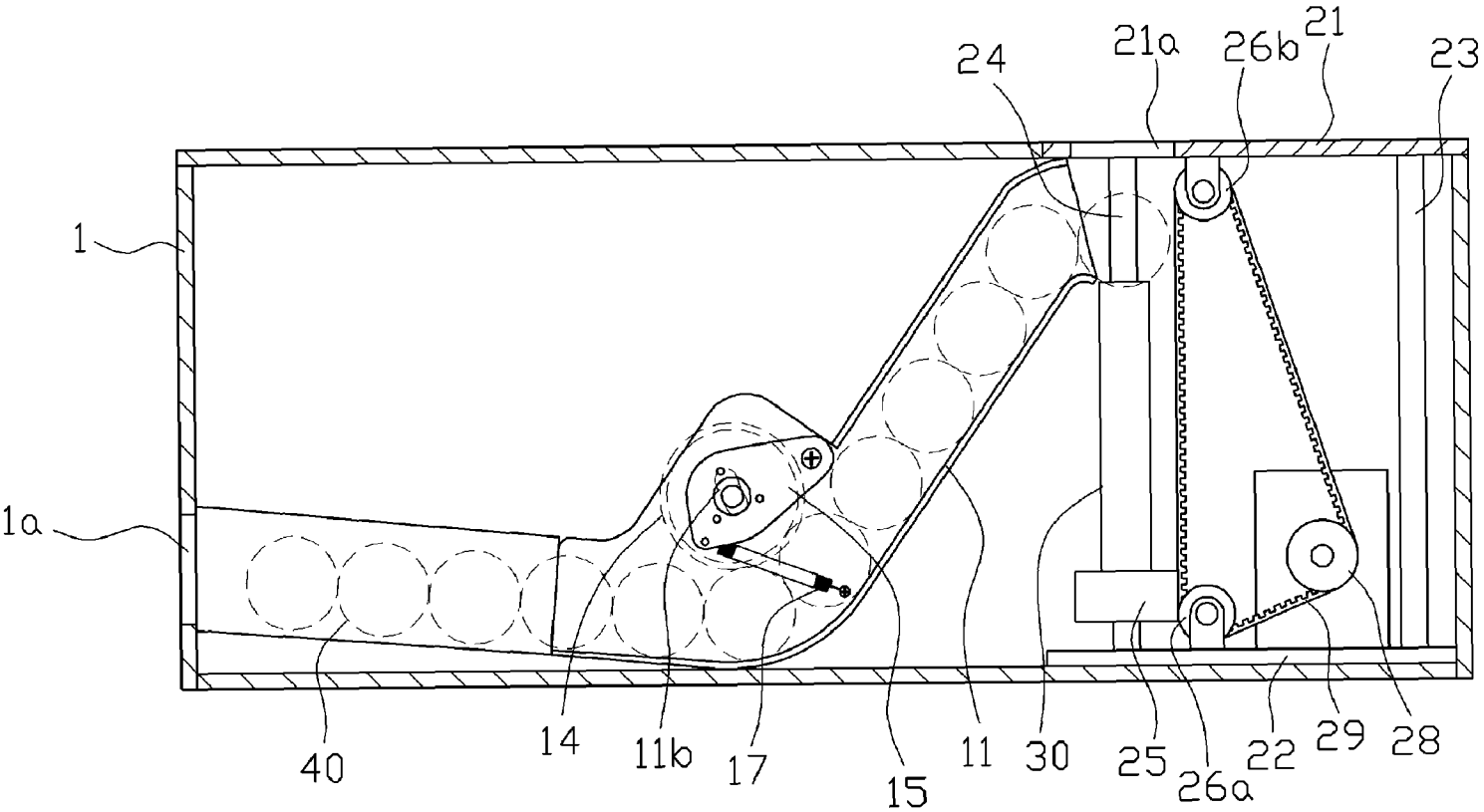
Figure 6:
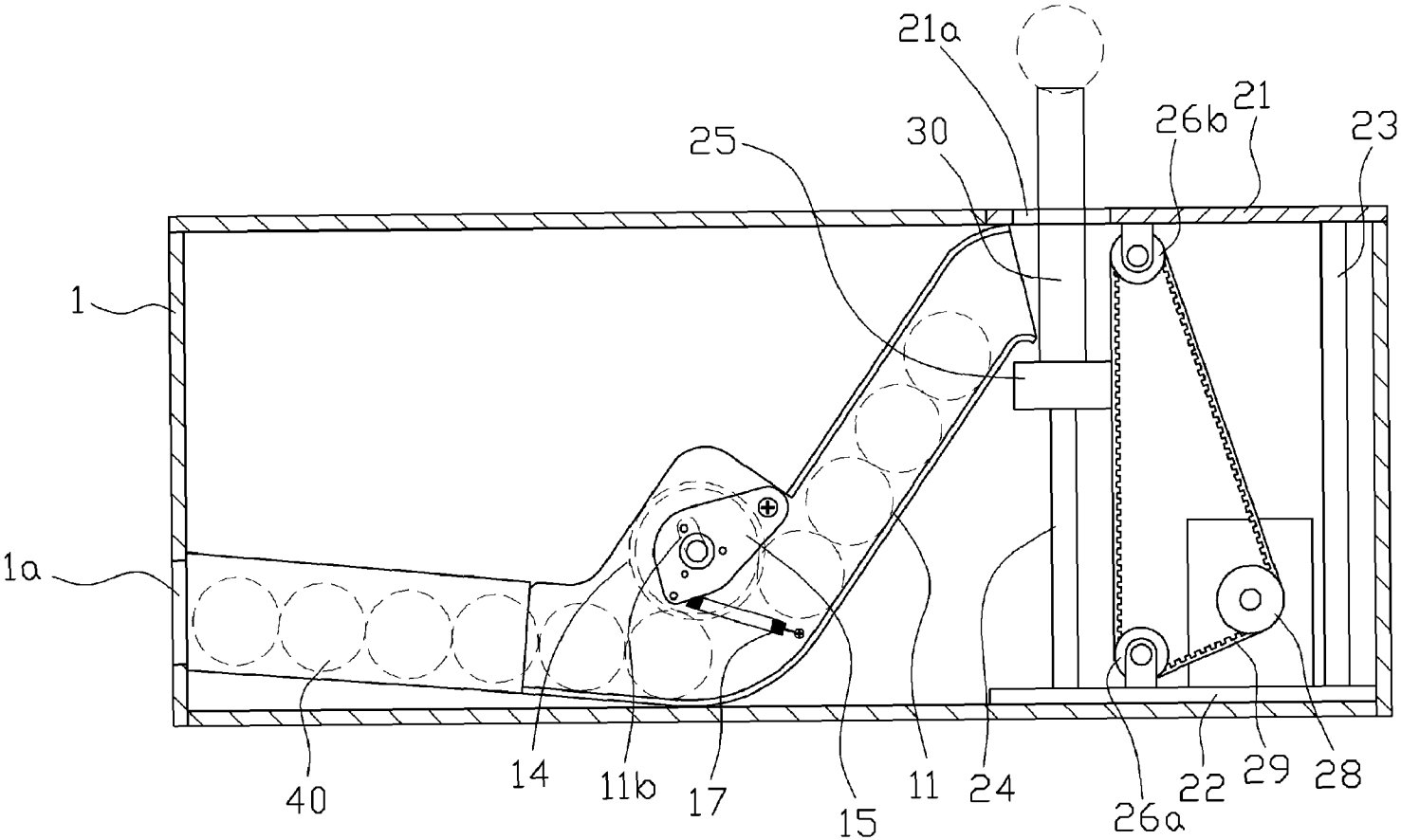

As shown in FIGS. 1 to 6, there is provided a golf ball feeding apparatus according to the present invention which has a feed unit 10 mounted at one side of the interior of a body 1 so as to feed a golf ball 40 and an adjustment unit 20 mounted at the other side of the interior of the body 1 so as to adjust the height of a golf tee 30, such that the golf ball 40 dispensed from the feed unit 10 is teed up on the golf tee 30 of the adjustment unit 20.

The feed unit 10 includes a main body 11 having a passage 11*a* through which the golf ball 40 passes, an inlet port 12 and an outlet port 13 formed at both ends of the passage 11*a*, and shaft holes 11*b* formed at both side walls thereof.

The feed unit 10 further includes a pulley 14 fittingly disposed between the shaft holes 11*b* of the main body 11 and movable plates 15 each having a bearing 15*a* mounted thereon and disposed on both outer sides of the shaft holes 11*b* of the main body 11 in such a manner as to be coupled at one side thereof to the main body 11 by means of shaft pins 16 and be connected at the other side thereof with a spring 17 mounted on the main body 11, thereby allowing the movable plates 15 and the pulley 14 to rotate about the shaft pins 16.

Also, the feed unit 10 has a feed motor 18 mounted at one side movable plate 15 and having a shaft 18*a* coupled to the bearing 15*a* and the pulley 14, so that as the feed motor 18 is activated, the pulley 14 is rotated.

The adjustment unit 20 includes a lower plate 22, a support rod 23 erected on the lower plate 22, and an upper plate 21 mounted on the top end of the support rod 23.

The upper plate 21 has an entry/exit hole 21*a* formed on one side thereof, through which a golf tee 30 passes.

The adjustment unit 20 further includes guide rods 24 mounted at left and right sides on the underside of the entry/exit hole 21*a* in such a manner as to be fixed between the upper plate 21 and the lower plate 22.

An elevating board 25 is adapted to insertedly fit around the guide rods 24 in such a manner as to move upwardly and downwardly along the guide rods 24.

The golf tee 30, made from a rubber material, is mounted on the elevating board 25, and also, the golf tee 30 has a sensor (not shown) mounted at the lower end thereof so as to check whether the golf ball 40 is located on the top end thereof.

Further, the adjustment unit 20 has gears 26*a* and 26*b* mounted at the back side of the elevating board 25 in such a manner as to be located on the inner sides of the upper plate 21 and the lower plate 22, and a stepping motor 27 mounted on one side of the lower plate 22.

Additionally, a power gear 28 is located on the shaft of the stepping motor 27, and a timing belt 29 is adapted to couple the power gear 28 and the gears 26*a* and 26*b* thereto in such a manner as to be fixed to one side of the elevating board 25.

The inlet port 12 of the feed unit 10 is connected to an inlet hole 1*a* formed at the lower portion of one side of the body 1, and the golf ball 40 dispensed through the outlet port 13 of the feed unit 10 is teed up on the golf tee 30 of the adjustment unit 20.

Hereinafter, the effects of the golf ball feeding apparatus according to the present invention will be explained.

If the apparatus is installed in an indoor golf training facility, first, a recess having a width and a height of the body 1 is formed on the floor where the golf tee 30 is placed, and thereafter, the apparatus is fixedly mounted into the recess. After that, appropriate electrical wirings are established, and the upper portion of the apparatus except the entry/exit hole 21*a* is covered with a mat. At one side of the body 1 of the golf ball feeding apparatus is provided a golf ball feeding passage through which the golf balls 40 are collected and fed, and one side end portion of the golf ball feeding passage is located into the inlet hole 1*a* of the body 1, thereby completing the installation of the golf ball feeding apparatus.

When golf training is performed with the golf ball feeding apparatus according to the present invention, a controller (not shown) is operated to determine an appropriate height of the golf tee 30 for the golfer. When the stepping motor 27 is operated by the controller, the power gear 28 is rotated.

The rotational force of the power gear 28 is transferred to the elevating board 25 through the gears 26*a* and 26*b* and the timing belt 29, and at this time, the rotational force of the timing belt 29 is converted into an upward movement by means of the gears 26*a* and 26*b* and the guide rods 24, so that the elevating board 25 is moved upwardly along the guide rods 24.

When the elevating board 25 is moved upwardly to reach a maximum upward movement position, an operation switch (not shown) such as a reed switch is operated to stop the operation of the stepping motor 27. Thereafter, the stepping motor 27 is rotated reversely to permit the elevating board 25 to move downwardly, and at this time, if the golf tee 30 is located at the appropriate height for the golfer, the controller is operated by the golfer to stop the stepping motor 27. As a result, the elevating board 25 stops, and the height of the elevating board 25 stopped is memorized by the controller.

After the golf tee 30 has been adjusted to the appropriate height for the golfer, next, if the apparatus of the present invention is operated, the feed motor 18 is operated to rotate the pulley 14. While the pulley 14 is being rotated, the golf ball 40 fed from the golf ball feeding passage is supplied to the pulley 14 through the inlet hole 1*a* and the inlet port 12.

The golf ball 40 supplied to the pulley 14 pushes the pulley 14 to some degree with a force applied during the supply, and the force allows the pulley 14, the movable plates 15 and the feed motor 18 to be rotated around the shaft pins 16 by means of the guide of the shaft holes 11*b*, thereby raising the pulley 14 to a certain degree, the movable plates 15 and the feed motor 18. With the rotational force of the pulley 14, therefore, the golf ball 40 is pushed upwardly over the pulley 14 along the passage 11*a* of the body 11.

The golf ball 40 pushed upwardly is dispensed through the discharge port 13 and is fed to the golf tee 30 of the adjustment unit 20 that stands by under the discharge port 13.

If the golf ball 40 is fed to the golf tee 30, the sensor mounted at the lower portion of the golf tee 30 senses the presence of the golf ball 40 to operate the stepping motor 27 and to stop the operation of the feed motor 18.

If the operation of the feed motor 18 stops, the pulley 14, the movable plates 15 and the feed motor 18 are returned to their original position by means of the tension of the springs 17.

At the same time, the stepping motor 27 is operated to move the elevating board 25 upwardly, and at this time, the rotation of the stepping motor 27 is stopped at the height of the golf tee 30 set by the golfer, so that the upward movement of the elevating board 25 is stopped to allow the golf ball 40 to be positioned on the golf tee 30 having the height appropriate for the golfer.

If the golf ball 40 hits and, thus, the golf ball 40 is not presented on the golf tee 30, the sensor senses the absence of the golf ball 40 on the golf tee 30, and the stepping motor 27 is operated to move the elevating board 25 downwardly. At the same time, the feed motor 18 is operated to allow the golf ball 40 to be fed to the golf tee 30.

As mentioned above, the golf ball feeding apparatus according to the present invention can supply the golf balls automatically, thereby removing inconveniences caused by manually feeding the golf balls to the golfer, and reducing the labor costs in the golf training facility required to collect and supply the golf balls.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

The invention claimed is:

1. A golf ball feeding apparatus comprising:

a feed unit 10 mounted at one side of an interior of a body 1 so as to feed a golf ball 40; and an adjustment unit 20 mounted at an other side of the interior of the body 1 so as to adjust a height of a golf tee 30, wherein the feed unit 10 comprises:

a main body 11 having a passage 11*a* through which the golf ball 40 passes, an inlet port 12 and an outlet port 13 formed at both ends of the passage 11*a*, and shaft holes 11*b* formed at both side walls thereof;

a pulley 14 fittingly disposed between the shaft holes 11*b* of the main body;

movable plates 15 each having a bearing 15*a* mounted thereon and disposed on both outer sides of the shaft holes 11*b* of the main body 11 in such a manner as to be coupled at one side thereof to the main body 11 by means of shaft pins 16 and be connected at the other side thereof with a spring 17 mounted on the main body 11, thereby allowing the movable plates 15 and the pulley 14 to rotate about the shaft pins 16; and a feed motor 18 mounted at one side movable plate 15 and having a shaft 18*a* coupled to the bearing 15*a* and the pulley 14 so as to rotate the pulley 14 by the activation thereof, and wherein the adjustment unit 20 comprises:

an upper plate 21 having an entry/exit hole 21*a* formed at one side thereof;

a lower plate 22;

a support rod 23 disposed between the upper plate 21 and the lower plate 22 so as to fixedly support the upper plate 21 and the lower plate 22;

guide rods 24 mounted at left and right sides on the underside of the entry/exit hole 21*a* in such a manner as to be fixed between the upper plate 21 and the lower plate 22;

an elevating board 25 adapted to insertedly fit around the guide rods in such a manner as to move upwardly and downwardly along the guide rods 24;

the golf tee 30 mounted on the elevating board 25;

gears 26*a* and 26*b* mounted at the back side of the elevating board 25 in such a manner as to be located on the inner sides of the upper plate 21 and the lower plate 22;

a stepping motor 27 mounted on one side of the lower plate 22;

a power gear 28 located on the shaft of the stepping motor 27; and a timing belt 29 adapted to couple the power gear 28 and the gears 26*a* and 26*b* thereto in such a manner as to be fixed to one side of the elevating board 25, whereby the golf ball 40 dispensed through the outlet port 13 of the feed unit 10 is teed up on the golf tee 30 of the adjustment unit 20.

* * * * *